US010202729B2

(12) United States Patent
Tothill et al.

(10) Patent No.: US 10,202,729 B2
(45) Date of Patent: Feb. 12, 2019

(54) MOBILE BRIDGE MODULE

(71) Applicant: BAE SYSTEMS plc, London (GB)

(72) Inventors: Ian Edward Tothill, Leeds (GB); Timothy John Davis, Leeds (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 15/541,437

(22) PCT Filed: Jan. 4, 2016

(86) PCT No.: PCT/GB2016/050005

§ 371 (c)(1),
(2) Date: Jul. 3, 2017

(87) PCT Pub. No.: WO2016/110681

PCT Pub. Date: Apr. 17, 2016

(65) Prior Publication Data

US 2017/0356145 A1 Dec. 14, 2017

(30) Foreign Application Priority Data

Jan. 5, 2015 (GB) ..... 1500053.2

(51) Int. Cl.

| | |
|---|---|
| ***E01D 22/00*** | (2006.01) |
| ***E01D 15/12*** | (2006.01) |
| ***E01D 19/12*** | (2006.01) |
| ***E01D 15/133*** | (2006.01) |
| *E01D 101/30* | (2006.01) |
| *E01D 101/34* | (2006.01) |

(52) U.S. Cl.

CPC ..... *E01D 22/00* (2013.01); *E01D 15/12* (2013.01); *E01D 15/124* (2013.01); *E01D 15/133* (2013.01); *E01D 19/12* (2013.01); *E01D 2101/30* (2013.01); *E01D 2101/34* (2013.01)

(58) Field of Classification Search

CPC ..... E01D 15/124; E01D 15/133; E01D 6/00; E01D 21/00; E01D 15/24; E01D 15/02; E01D 15/12; E01D 19/04; E01D 19/12

See application file for complete search history.

(56) References Cited

U.S. PATENT DOCUMENTS 294,606 A 3/1884 Frits
3,156,041 A * 11/1964 Gault ..... B23K 1/0014 228/181

(Continued)

FOREIGN PATENT DOCUMENTS

CN 102720123 A 10/2012
DE 19724771 C1 10/1998

(Continued)

OTHER PUBLICATIONS

International Search Report and Written Opinion received for Patent Application No. PCT/GB2015/050005, dated Mar. 30, 2016. 14 pages.

(Continued)

*Primary Examiner* — Abigail A Risic
(74) *Attorney, Agent, or Firm* — Finch & Maloney PLLC

(57) ABSTRACT

A mobile bridge module includes a reinforcement applied in a non-destructive manner. This might alternatively and/or additionally be defined as a non-destructively reinforced mobile bridge module.

20 Claims, 2 Drawing Sheets

(56) References Cited

U.S. PATENT DOCUMENTS

Figure 1:
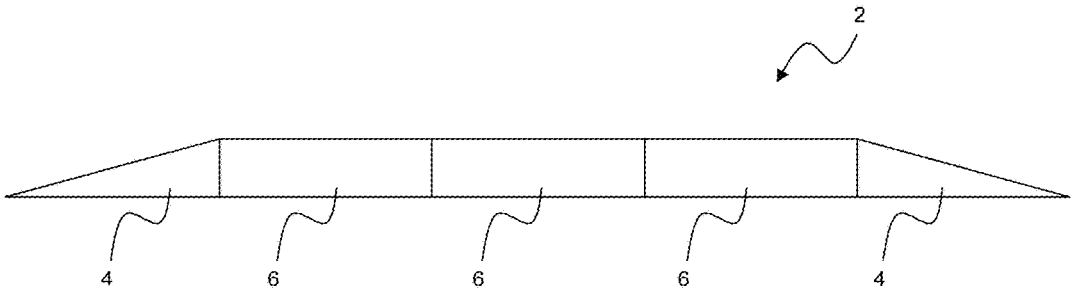

| | | | | |
|---|---|---|---|---|
| 3,499,179 | A | 3/1970 | Weld | |
| 3,504,389 | A * | 4/1970 | Longbottom | E01D 15/133 14/13 |
| 4,075,727 | A * | 2/1978 | Sedlacek | E01D 15/133 14/14 |
| 4,222,140 | A | 9/1980 | Olewinski et al. | |
| 4,663,793 | A | 5/1987 | Parramore | |
| 5,329,652 | A * | 7/1994 | Wiedeck | E01D 15/127 14/2.5 |
| 5,398,462 | A | 3/1995 | Berlin et al. | |
| 6,446,292 | B1 * | 9/2002 | Fuessinger | E01D 15/133 14/2.4 |
| 9,279,221 | B1 * | 3/2016 | Orona | E01D 15/124 |
| 2008/0061959 | A1 | 3/2008 | Breed | |
| 2009/0106918 | A1 | 4/2009 | Van Roosmalen et al. | |
| 2010/0017975 | A1 * | 1/2010 | Kennedy | E01D 15/133 14/6 |
| 2011/0119842 | A1 | 5/2011 | Park | |
| 2011/0250014 | A1 | 10/2011 | Corser | |
| 2012/0173150 | A1 | 7/2012 | Romero et al. | |
| 2014/0309767 | A1 | 10/2014 | Liao et al. | |
| 2015/0316426 | A1 | 11/2015 | Feichtinger et al. | |
| 2016/0145815 | A1 * | 5/2016 | Motavalli | E01D 22/00 52/126.1 |
| 2016/0171309 | A1 | 6/2016 | Hay | |
| 2017/0184550 | A1 | 6/2017 | Kobayashi | |

FOREIGN PATENT DOCUMENTS

| | | | | |
|---|---|---|---|---|
| DE | 202010010909 | U1 | | 1/2012 |
| EP | 0490771 | A1 | | 6/1992 |
| EP | 0653616 | A2 | | 5/1995 |
| EP | 0916769 | A1 | | 5/1999 |
| GB | 1137278 | A | | 12/1968 |
| GB | 2469752 | A | | 10/2010 |
| JP | 2005-30786 | A | | 2/2005 |
| JP | 2010144512 | A | * | 7/2010 |
| KR | 200444674 | Y1 | | 5/2009 |
| KR | 20120050938 | A | | 5/2012 |
| KR | 101344722 | B1 | | 12/2013 |
| KR | 20140001586 | A | | 1/2014 |
| WO | 2009126869 | A2 | | 10/2009 |
| WO | 2016110680 | A1 | | 7/2016 |
| WO | 2016110681 | A1 | | 7/2016 |

OTHER PUBLICATIONS

GB Intellectual Property Office Search Report under Section 17(5) received for GB Patent Application No. 1500054.0 dated May 28, 2015. 4 pages.

International Search Report and Written Opinion received for Patent Application No. PCT/GB2015/050004, dated Mar. 29, 2016. 9 pages.

GB Intellectual Property Office Search Report under Section 17(5) received for GB Patent Application No. 1500053.2 dated May 28, 2015. 4 pages.

Ghafoori, et al., "Fatigue strengthening of damaged metallic beams using prestressed unbonded and bonded CFRP plates," International Journal of Fatigue, vol. 44, Elsevier, 2012. pp. 303-315.

Taljsten, et al., "Strengthening of old metallic structures in fatigue with prestressed and non-prestressed CFRP aminates," Construction and Building Materials, vol. 23, Elsevier, 2009. pp. 1665-1677.

International Preliminary Report on Patentability received for Patent Application No. PCT/GB2016/050004, dated Jul. 20, 2017. 7 pages.

International Preliminary Report on Patentability received for Patent Application No. PCT/GB2016/050005, dated Jul. 20, 2017. 8 pages.

* cited by examiner

MOBILE BRIDGE MODULE

The present invention relates generally to a mobile bridge module, and in particular a reinforced mobile bridge module, and to a related method of reinforcing a mobile bridge module.

A mobile bridge apparatus might be used in a wide variety of applications, ranging from temporarily bridging a river or the like in the event of a failure of a permanent bridge, all the way through to the need to quickly and effectively bridge a gap or other obstacle in a military environment. A mobile bridge apparatus typically comprises one or more mobile bridge modules in the form of one or more ramp modules, and/or one or more inter-ramp modules.

It may sometimes be necessary to in some way reinforce a mobile bridge apparatus, and in particular mobile bridge modules of that apparatus. The reinforcement may be required to in some way strengthen or otherwise support weakened sections of the module. Weakening via fatigue may occur during use of a module. Alternatively or additionally, such reinforcement may be required simply to strengthen the module, for example in advance of an expected increase in use or loading of that module.

Typically, reinforcement will take the form of attaching a reinforcing element of some kind to the module by way of welding or riveting, or via similar techniques that involved modification of the module's structure in some way. Although this may be a convenient way of attaching the reinforcing element, and at least to some extent reinforcing an appropriate part of the bridge module, there is a disadvantage in common with existing reinforcing techniques. The disadvantage is that the reinforcing method itself in some way weakens the module, even if that weakening is in some way different to the weakening that the reinforcement is intended to overcome.

Attaching a reinforcing element by way of riveting or bolting will result in punctures or other apertures being formed in the mobile bridge module. These punctures or apertures may introduce points of weakness in the module, and/or points at which stress or strain may be focussed, which could lead to weakening and/or damage in future. In general, then, bolting or riveting or similar will reduce the original section properties of the module.

Welding a reinforcing element to the module, or simply welding of the module directly, may reduce the strength of the module at or adjacent to the weld region, mainly by virtue of heat affecting structural properties in or adjacent the weld region, but also by introducing points of geometric stress concentration that may shorten the usable life of the module.

Therefore, even though typical reinforcing methods may result in a degree of reinforcement of the mobile bridge module, the methods themselves may result in a (new) weakening being introduced into the mobile bridge module.

One way of attempting to overcome the problems mentioned above, even when recognised in advance, is to additionally reinforce the mobile bridge module in the expectation and knowledge that at least part of the method could result in weakening. Disadvantages here include an increase in material, cost and weight used in any reinforcement. Also, there is a significant risk that the additional reinforcement may itself inadvertently introduce other areas of weakness, for example in the manner as already described.

It is an example aim of example embodiments of the present invention to at least partially obviate or mitigate one or more of the disadvantages mentioned above or elsewhere in the prior art, or to at least provide an alternative to existing mobile bridge apparatus and related methods.

According to the present invention there is provided an apparatus and method as set forth in the appended claims. Other features of the invention will be apparent from the dependent claims, and the description which follows.

According to a first aspect of the present invention, there is provided a mobile bridge module comprising a reinforcement applied in a non-destructive manner. This might alternatively and/or additionally be defined as a non-destructively reinforced mobile bridge module.

The reinforcement may comprise a bonded reinforcement.

The reinforcement may comprise: bonding material; and/or a reinforcement element bonded to the module using bonding material.

The reinforcement might be a preformed reinforcement, and/or a unitary reinforcement.

The reinforcement might have a strip-like shape.

The reinforcement may comprise one or more of: a laminate; and/or a composite; and/or a metal/binder laminate; and/or a fibre/binder laminate.

The reinforcement may comprise one or more of: a resin binder; and/or a ceramic binder; and/or an epoxy adhesive.

The reinforcement may comprise spacers and/or high aspect ratio fillers.

The reinforcement might comprise at least a part of a deformation sensor for use in sensing a deformation of the mobile bridge module.

The reinforcement may be applied to an I-beam structure of the mobile bridge module, optionally a flange of the I-beam, and optionally a lower flange of the I-beam.

The reinforcement may be applied to a tension chord of the module/bridge apparatus.

To avoid any misunderstanding, the reinforcement is an addition to an original structure of the mobile bridge module.

According to a second aspect of the present invention, there is provided a mobile bridge apparatus comprising a mobile bridge module, the mobile bridge module comprising a reinforcement applied in a non-destructive manner.

The mobile bridge apparatus might comprise: two mobile bridge ramp modules connected together by one or more inter-ramp mobile bridge modules. One, more or all of the ramp and/or inter-ramp modules might comprise a reinforcement applied in a non-destructive manner.

According to a third aspect of the present invention, there is provided a method of reinforcing a mobile bridge module, the method comprising non-destructively reinforcing the mobile bridge module.

Prior to reinforcing, the method may comprise preparing a mating surface of the mobile bridge module, and/or a mating surface of a reinforcement, to provide at least one chemically active mating surface for use in the reinforcing.

The preparing might comprise grit blasting and/or cleaning and/or modifying.

After a reinforcement element has been bonded to the mobile bridge module using bond material as part of the reinforcing, the method may comprise clamping the reinforcement element in position until the bond material has cured, or at least cured to an extent sufficient to hold the reinforcement element in position.

It will be appreciated that any feature described in relation to any one aspect of the present invention may be used in combination with or in place of a feature of any other aspect of the present invention, unless such replacement and/or combination would be understood by the skilled person from a reading of the disclosure to be mutually exclusive. Such replacement/combination is particularly the case when features described in relation to an apparatus may be used as part of a related method, or where features of a method may be used as part of a related apparatus or in the use of that apparatus.

Figure 2:
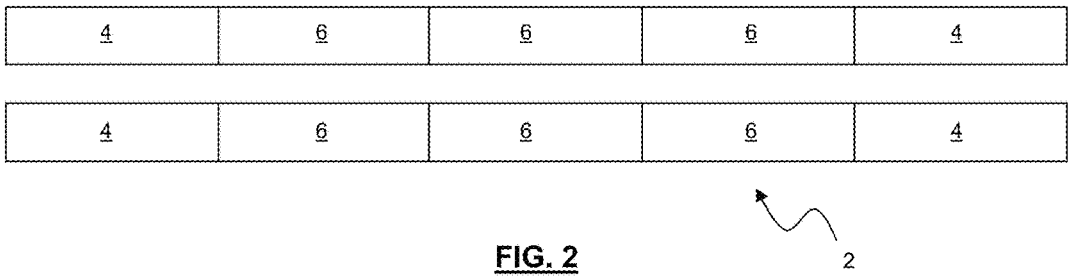
Figure 3:
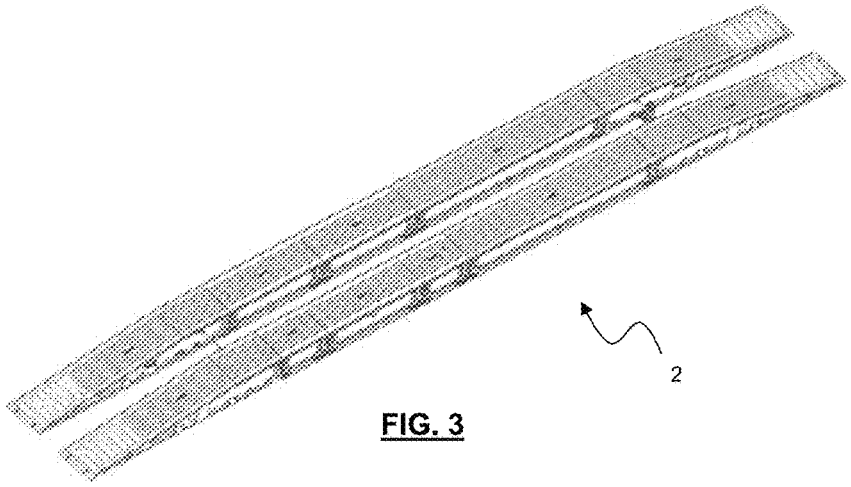
Figure 4:
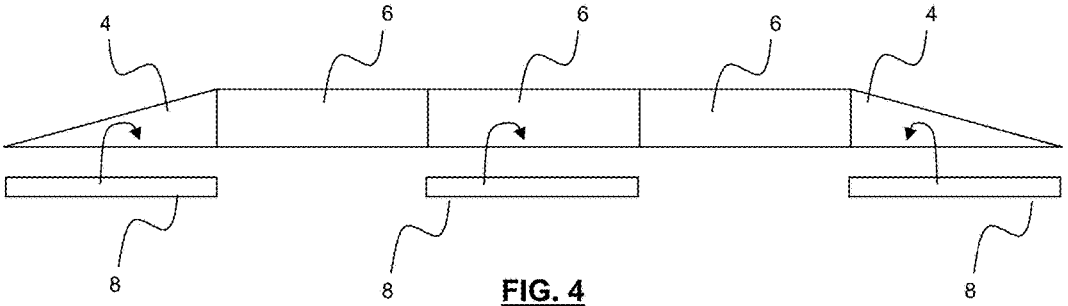
Figure 5:
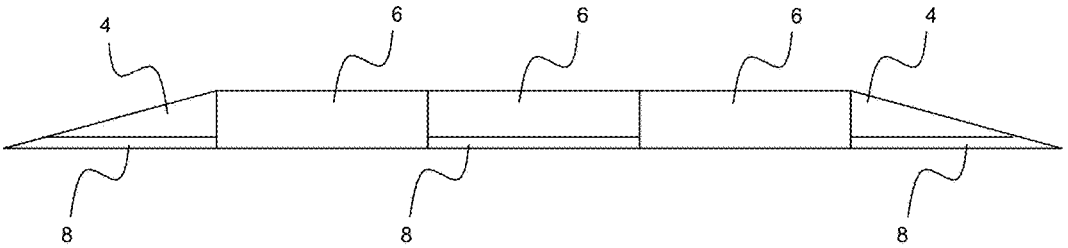
Figure 6:
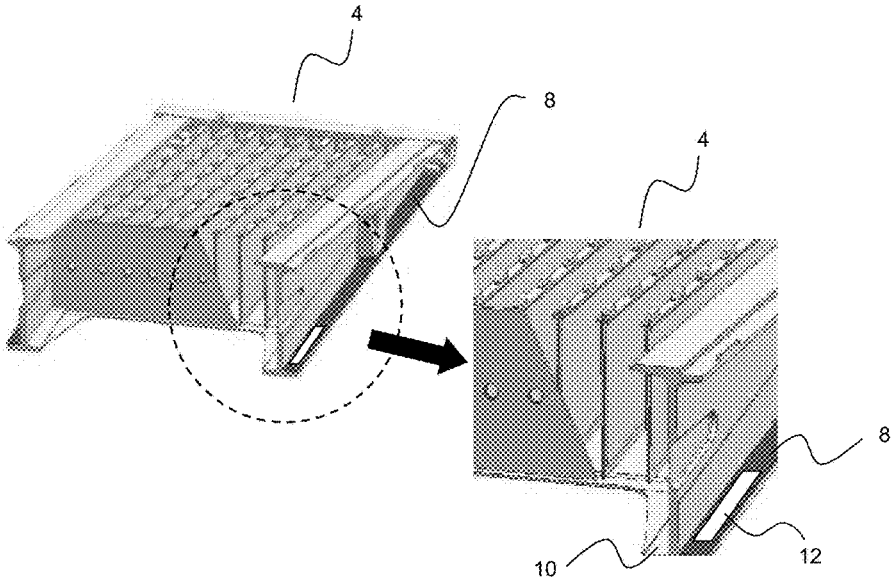

For a better understanding of the invention, and to show how embodiments of the same may be carried into effect, reference will now be made, by way of example, to the accompanying diagrammatic Figures in which:

FIG. 1 schematically depicts a side view of a mobile bridge apparatus comprising a plurality of mobile bridge modules;

FIG. 2 schematically depicts a plan view of the mobile bridge apparatus of FIG. 1;

FIG. 3 schematically depicts a perspective view of the mobile bridge apparatus of FIGS. 1 and 2;

FIG. 4 schematically depicts reinforcement of mobile bridge modules of the mobile bridge apparatus of FIG. 1, in accordance with an example embodiment;

FIG. 5 shows the mobile bridge apparatus of FIG. 1, with certain mobile bridge modules provided with reinforcement elements, in accordance with an example embodiment; and FIG. 6 schematically depicts an example of a deformation sensor being installed on a mobile bridge module as part of a non-destructive reinforcement of that module, in accordance with an example embodiment.

The Figures have not been drawn to any particular scale, and are simply given as an aid to understanding concepts underlying and/or representing the invention. Also, the same features appearing in different Figures have been given the same reference numerals for consistency and clarity.

FIG. 1 schematically depicts a mobile bridge apparatus 2 in side view. The apparatus comprises ramp modules 4 connected together by inter-ramp modules 6. The modules 4, 6 are in connection with one another. The nature of the connection will depend on the nature of the specific type and use of the mobile bridge apparatus. For example, the modules 4, 6 may be in some way hingedly or foldably attached to one another for use in convenient deployment of the mobile bridge apparatus 2, for example from a vehicle or the like. In another example, the modules may be connected to one another via one or more cables or other elongate connectors. Other connection arrangements are of course possible.

The mobile bridge apparatus 2 may be used in a wide variety of applications, and might be used by people, animals, vehicles, and so on. The exact construction of the mobile bridge apparatus 2 may depend on its intended use. For example, there may be variations in terms of materials, structure, and so on. Many mobile bridge apparatus used to carry vehicles are made from an at least partial aluminium construction (e.g. a main frame or main structure of the apparatus), since aluminium is light but strong.

FIG. 2 shows a plan view of the apparatus of FIG. 1. The plan view reveals that the mobile bridge apparatus 2 may comprise two substantially parallel trains or series of modules 4, 6, for example for supporting different wheel or tracks of different sides of a vehicle. Although not shown in the Figure, the parallel trains or series of modules 4, 6 may be separate from one another, or attached to one another, and deployed at the same time, or separately. In another example, a parallel train or series of modules 4, 6 may not be required. That is, a single train or series of modules 4, 6 may suffice.

FIG. 3 shows the mobile bridge apparatus in perspective view, to give some more context to the overall look and function of the apparatus 2.

As already discussed above, it may sometimes be necessary or desirable to in some way reinforce one or more parts of a mobile bridge module of a mobile bridge apparatus, such as the modules and apparatus of FIGS. 1-3. However, existing mobile bridge module specific techniques and methods for achieving such reinforcement are disadvantageous, since they might lead to additional, different, or inadvertent weakening of the mobile bridge module that is reinforced, and/or might require additional reinforcement to counter these problems, which in addition could lead to an increase in weight, cost and/or complexity.

According to an example embodiment, the problems referred to above can be obviated or mitigated. In accordance with an example embodiment, a mobile bridge module is non-destructively reinforced. This might seem at first sight as a trivial solution to the problems previously described. However, even if somewhat trivial in terms of implementation, non-destructive reinforcement is a technique which has simply not in any way been contemplated in this field, despite the numerous and significant advantages and benefits associated with such a technique.

Perhaps first and foremost, non-destructively reinforcing a mobile bridge module means that the module is in no way weakened during, or as a result of, the process of reinforcement. Clearly, this is a very significant benefit, and avoids the weakening inherent in existing reinforcement techniques, and/or the additional reinforcement that might be required to avoid or take into account such weakening. Secondly, non-destructive reinforcement might be far simpler to implement than, for example, riveting, welding or similar. For instance, if the reinforcement comprises or involves bonding or similar, then the bonding might be achieved by a relatively unskilled person, or by someone who is more readily available at short notice, or simply more easily. Clearly, this is very advantageous in its own right, but there are also related advantages. The related advantages might include the fact that the repair could be undertaken with little or no preparation time, specialist equipment, and so on.

Thus, even though the solution of example embodiments is arguably simple, it is extremely effective. Also, there is synergy, in that typically lightweight non-destructive reinforcing lends itself well to lightweight mobile bridge modules. Also, non-destructive reinforcement may not last as long as more destructive reinforcement, but may nevertheless last as long as is required for a period when a mobile bridge apparatus is used. For example, more heavy duty 'permanent' reinforcement of 'permanent'/fixed bridges would be excessive in a mobile bridge environment.

Example implementations will now be descried with reference to FIGS. 4-6.

FIG. 4 shows the mobile bridge apparatus 2 as already shown in and described with reference to FIGS. 1-3. FIG. 4 also shows the non-destructive reinforcement of certain modules 4, 6 using reinforcement 8.

The reinforcement 8 could be a bond or the like, for example comprising bonding material or similar. The bonding material could be applied in a relatively fluid form, and allowed to cure or set, in order for reinforcement to take place. However, in this particular embodiment the reinforcement is a reinforcement element 8 that is bonded to the respective module 4, 6.

It can be seen that the reinforcement 8 is not part of the original structure of the mobile bridge module 4, 6 mobile bridge apparatus 2. The reinforcement 8 is added to that original structure. It is possible that the reinforcement 8 will comprise a material that is different to the material of the mobile bridge apparatus 2. For instance, the mobile bridge apparatus, or at least a substantive part thereof, will typically comprise aluminium, due aluminium's relative strength to weight balance. The reinforcement 8, on the other hand, could typically comprise another material, as described below. The material could be the same or similar, to avoid issues with different thermal expansion coefficients.

The reinforcement element 8 will typically be pre-formed, for example in the form of a particular shape or the like that will correspond/conform to the shape/surface of the area or part thereof that has to be reinforced. For instance, the reinforcement 8 might conveniently and typically take the form of a strip of material. A strip is not an arbitrary choice of shape. Many parts of the mobile bridge module 4, 6 will be elongate in nature, for example struts or the like, which may be readily reinforced using strips. Alternatively and/or additionally, one or more strips may be used, together, to conveniently reinforce a non-strip like shape, or cut to form a non-strip like shape. Thus, the strip like shape provides convenience in the reinforcement method.

The reinforcement element 8 might conveniently be in unitary form, that is requiring no additional components. In this example, the reinforcement element 8 might already be provided with a bond material applied thereto. A protective strip or barrier or the like may be removed from the bond material, to allow the reinforcement element 8 as a whole to be bonded to the appropriate part of the bridge module 4, 6.

The reinforcement element 8 may be applied as and when it is determined that reinforcement is required. Typically, some form of preparation of one or more mating surfaces may be required beneficial in advance of the reinforcement being applied, to ensure that the reinforcement remains in place as intended. If bonding is used as part of the reinforcement, then it is likely that some form of surface preparation will be required to ensure that the one or more mating surfaces are chemically active. This might be conveniently achieved by one or both of grit blasting, and/or modifying, and/or cleaning using water or some other fluid. The general surface modification may be achieved chemically and/or physically.

The method of bonding may be such that the bonding is extremely quick. Nevertheless, some degree of fixation of the bond, or reinforcement element attached using that bond, may be required to ensure that the reinforcement serves as intended, for example in the required position and/or orientation. Conveniently, this may be achieved by clamping a reinforcing element in position until the bond material has cured, or at least cured to an extent sufficient to hold the reinforcement element in the required position/orientation.

Curing may be caused or facilitated by chemical reagents, UV or heat or a combination thereof.

FIG. 5 shows the mobile bridge apparatus 2 of FIG. 4, but now with the reinforcing elements 8 in place. The mobile bridge apparatus may now be used, used more safely, used more frequently, and so on.

FIG. 6 shows how a ramp module 4 of the mobile bridge apparatus may be non-destructively reinforced via use of a reinforcement element 8 that is bonded, or otherwise adhered or non-destructively attached to a portion 10 of the module 4 requiring reinforcement. Conveniently, a deformation sensor 12, or at least a part thereof, may constitute at least a part of the reinforcement element 12, all being installed at the same time as, or as part of, the installation of that reinforcement element 12. The convenience lies in timing, in that two functions are achieved in one method step, and also in that the location of the reinforcement is likely to be in a same or similar location as the sensing of deformation. That is, it is likely that a part of the bridge module that is subjected to most deformation, therefore requiring reinforcement, is also likely to be a critical part of the bridge module for the assessment of fatigue.

At least a part of the sensor may be located in or attached to the reinforcement element, as mentioned above. The sensor, or a part thereof, might be located within a laminate form of reinforcing element, or on such an element, and so on. The part of the sensor could be a fibre or layer or similar, which might deform with the module.

As alluded to above, irrespective and independent of any reinforcement that may/may not be required, it is likely that a good place to locate a sensor for sensing deformation and thus fatigue of a module will be in or on a critical part of the module where deformation and thus fatigue is likely to be high and/or of importance to the structural integrity of the bridge. Depending on the construction of the bridge, this might be a location on a lower part or underside of a module, where tension/strain might be highest.

A sensor may be used to indicate an age of a reinforcement member due to fatigue, or might indicate when replacement is required. If a sensor is used in isolation, the sensor may be used to indicate an age of a part of the module, which might be useful when determining if reinforcement is required.

In FIG. 6, an I-shaped beam is the part of the module 4 that is reinforced. It is this beam that will likely be the part that takes most loading, and will likely be the part that is most likely to need reinforcement. This is particularly true of the flange of the I-shape, and more particularly still of the lower flange, where strain/tension/deformation might be highest. FIG. 6 thus shows the reinforcement element 8 as applied to the lower flange of the I-shaped beam. Lower means the part away from the surface of the module over which a vehicle might travel—i.e. opposite the loading surface, and thus where tension might be greater.

The I-shaped beam, or the flange thereof, might be additionally or alternatively referred to as a tension chord. Additionally or alternatively a tension chord may be a separate element. The tension chord may be used to bring together the different modules, and may also be a suitable part of the module/apparatus as a whole to be reinforced.

Generally, the reinforcement might be used to increase the resistance of the tension load path of the structure (or part thereof) to which it is applied, and thus increase the module/bridge bending resistance.

The non-destructive reinforcement may take any one of a number of different forms, as and where appropriate to the nature and intent of the reinforcement that is required. For instance, the reinforcement may depend on the nature of the weakening or damage to the mobile bridge module, or the expected loads that the mobile bridge module is to be exposed to after reinforcement, and so on. However, there may still be arrangements for the reinforcement that are particularly suited to being lightweight but strong, which will be important for ensuring that the mobile bridge module is sufficiently reinforced, yet still in a lightweight manner so as to not detract from the mobile nature of the apparatus as a whole.

A reinforcement might conveniently comprise one or more of a laminate structure, a composite structure, a metal/binder laminate, and/or a fibre/binder laminate. The composite and/or laminate nature might give a good balance of reinforcement capabilities versus size/weight of the reinforcement. A composite might comprise a mixture or alloy of materials. A reinforcement might conveniently comprise a metallic material.

The reinforcement, or the bond material if a bond material is used to attach a reinforcement element to the module, may comprise a resin binder, and/or a ceramic binder, and/or an epoxy adhesive (which could be a sub-set of a resin binder), all of which are useful in relatively quickly and securely fixing the reinforcement to the mobile bridge module.

Reinforcement (which includes bond material) might comprise spacers. The spacers might be useful for ensuring that there is a consistent spacing/distance between the part of the mobile bridge module that is to be reinforced, and any reinforcement element that is attached thereto using the bond material. This might improve reinforcement functionality and/or longevity.

The reinforcement (which includes the bond material) might include high aspect ratio fillers, which might give a significant increase in strength in one or more directions of the material, and thus the reinforcement as a whole. Fillers might be in the form of nanotubes, Graphene particles or structures, platelets, cylinders, or other non-spherical nanometer-scale components or structures.

The reinforcement described above may be implemented when the mobile bridge module, or the mobile bridge apparatus as a whole, is in-use/in an in-use configuration (i.e. in-situ). Alternatively, the reinforcement may be implemented before deployment of the mobile bridge apparatus or the like, or during a general repair or maintenance period for the mobile bridge apparatus as a whole.

The reinforcement of the mobile bridge module may be applied to any particular location of the module that requires reinforcement in some way. As already alluded to above, such a reinforcement might typically be located at an area of the bridge module which would typically experience highest deformation in the form of a plastic deformation, elastic deformation, fracture, stress, strain, tension, and so on. Sporadic damage or impact in or on a part of the module might require specific reinforcement. A typical location might be one or more struts, cross-struts or the like of the mobile bridge module, and/or might typically be or comprise a lower part or underside of one or more components of the mobile bridge module that might be subjected to greatest tension or strain. Tension members of each module are likely to experience greatest tension, and might thus require reinforcement.

Non-destructive reinforcement means that the structure of the module is not damaged during the reinforcement, for example by making one or more holes, cuts or weakenings in material forming the module. Bonding/adhering is a very convenient way of non-destructively reinforcing. In the embodiments described above, multiple mobile bridge modules have been described as being non-destructively reinforced. This might alternatively or additionally be described as the mobile bridge modules being reinforced in a non-weakening manner.

Bonding is a convenient way of achieving a good, effective non-destructive reinforcement. However, other non-destructive techniques may be used, for example, a binding reinforcement, using one or more bands or other structure that can wrap around a part of the module, or even the use of additive material using a printer or similar.

In the above embodiments, multiple mobile bridge modules have been described as being reinforced. Of course, only a single module might need to be reinforced. So, the inventive concept might lie in the reinforcement of a single module, multiple modules, and/or a mobile bridge apparatus comprising one or more of such modules.

The mobile bridge described herein is typically employed in (i.e. is capable of, and configured to be used in) a spanning capacity, for example spanning a gap or similar. Therefore, the bridge is able to support its own weight while still providing the spanning function. This is in contrast with, say, a pontoon bridge, where water supports the pontoon bridge. The bridge described herein will typically be free of any inter-gap supports, for example legs or otherwise, extending from the main bridging surface to a floor of the gap. That is, the bridged described herein is supported only on either side of the gap. The modules described herein are typically of a construction, for example a predominantly metallic construction, which is designed specifically for such a gap-spanning function. The construction is such that each module/the bridge as a whole would be incapable of floating in water without dedicated and separate floats or similar.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A gap-spanning mobile bridge apparatus comprising:

a first mobile bridge ramp module;

a second mobile bridge ramp module;

an inter-ramp mobile bridge module connected between the first mobile bridge ramp module and the second mobile bridge ramp module; and a reinforcement on an exterior surface of at least one of the first mobile bridge ramp module, the second mobile bridge ramp module, and the inter-ramp mobile bridge module, the reinforcement including a reinforcement element bonded to the exterior surface in a non-destructive manner, wherein the reinforcement is a pre-formed strip of material that is applied as a whole to an exterior surface of an I-beam structure of at least one module of the first mobile bridge ramp module, the second mobile bridge ramp module, and the inter-ramp mobile bridge module.

2. The mobile bridge apparatus of claim 1, wherein the reinforcement comprises a bonding material.

3. The mobile bridge apparatus of claim 1, wherein the reinforcement is a unitary reinforcement.

4. The mobile bridge apparatus of claim 1, wherein the reinforcement comprises one or more of:

a metal/binder laminate; and/or a fibre/binder laminate.

5. The mobile bridge apparatus of claim 1, wherein the reinforcement comprises one or more of:

a resin binder;

a ceramic binder; and/or an epoxy adhesive.

6. The mobile bridge apparatus of claim 1, wherein the reinforcement comprises at least a part of a deformation sensor for use in sensing a deformation of at least one of the first mobile bridge ramp module, the second mobile bridge ramp module, and the inter-ramp mobile bridge module.

7. The mobile bridge apparatus of claim 1, wherein the reinforcement is an addition to an unmodified original structure of at least one of the first mobile bridge ramp module, the second mobile bridge ramp module, and the inter-ramp mobile bridge module.

8. The mobile bridge apparatus of claim 1, wherein the first mobile bridge ramp module, the second mobile bridge ramp module, and the inter-ramp mobile bridge module are hingedly or foldably attached to one another.

9. The mobile bridge apparatus of claim 1, wherein the reinforcement is applied in a horizontal orientation to the at least one module.

10. The mobile bridge apparatus of claim 1, wherein the reinforcement comprises a predominantly metallic composition.

11. The mobile bridge apparatus of claim 1, wherein the reinforcement is bonded to the exterior surface of only the inter-ramp mobile bridge module.

12. The mobile bridge apparatus of claim 1, wherein the reinforcement is bonded only on a flange of the I-beam of the module, a lower flange of the I-beam of the module, or a combination thereof.

13. The mobile bridge apparatus of claim 1, wherein the reinforcement is attached to the exterior surface using only the bond material.

14. The mobile bridge apparatus of claim 13, wherein the reinforcement is bonded only on a flange of the I-beam of the module, a lower flange of the I-beam of the module, or a combination thereof.

15. A method of reinforcing a mobile bridge module of a gap-spanning mobile bridge apparatus, the gap-spanning mobile bridge apparatus comprising a first mobile bridge ramp module and a second mobile bridge ramp module connected together by a plurality of inter-ramp mobile bridge modules, the method comprising:

non-destructively reinforcing an exterior surface of at least one of the modules by bonding a reinforcement element to the exterior surface, wherein the reinforcement is a pre-formed strip of material that is applied as a whole to an exterior surface of an I-beam structure of at least one module of the first mobile bridge ramp module, the second mobile bridge ramp module, and the inter-ramp mobile bridge module, a flange of the I-beam of the module, or a lower flange of the I-beam of the module, or a combination thereof.

16. The method of claim 15, wherein, prior to reinforcing, the method comprises preparing a mating surface of the at least one of the modules, and/or a mating surface of a reinforcement, to provide at least one chemically active mating surface for use in the reinforcing.

17. The method of claim 16, wherein, after a reinforcement element has been bonded to the at least one of the modules using bond material as part of the reinforcing, the method comprises clamping the reinforcement element in position until the bond material has at least partially cured, to an extent sufficient to hold the reinforcement element in position, wherein the preparing comprises grit blasting and/or cleaning.

18. A gap-spanning mobile bridge apparatus comprising:

a mobile bridge module, the mobile bridge module including a reinforcement, wherein the reinforcement is an addition to the original structure of the mobile bridge module, wherein the reinforcement includes a bonding material and a reinforcement element bonded in a non-destructive manner to an exterior surface of the mobile bridge module using bonding material, and the bonding material includes one or more of a resin binder, a ceramic binder, and/or an epoxy adhesive, and wherein the reinforcement is a pre-formed strip of material that is applied as a whole to an exterior surface of an I-beam structure of at least one module of the first mobile bridge ramp module, the second mobile bridge ramp module, and the inter-ramp mobile bridge module, a flange of the I-beam of the module, or a lower flange of the I-beam of the module, or a combination thereof.

19. The mobile bridge apparatus of claim 18, wherein the reinforcement comprises spacers and/or high aspect ratio fillers.

20. The mobile bridge apparatus of claim 18, wherein the reinforcement comprises at least a part of a deformation sensor for sensing a deformation of the mobile bridge module.

* * * * *